US006972086B2

(12) United States Patent
Didillon et al.

(10) Patent No.: US 6,972,086 B2
(45) Date of Patent: Dec. 6, 2005

(54) PROCESS COMPRISING TWO GASOLINE HYDRODESULFURIZATION STAGES AND INTERMEDIATE ELIMINATION OF H2S FORMED DURING THE FIRST STAGE

(75) Inventors: Blaise Didillon, Francheville (FR); Denis Uzio, Marly le Roi (FR); Jean-Luc Nocca, Houston, TX (US); Quentin Debuisschert, Rueil Malmaison (FR)

(73) Assignee: Institut Français du Pétrole, Rueil-Malmaison (FR)

( * ) Notice: Subject to any disclaimer, the term of this patent is extended or adjusted under 35 U.S.C. 154(b) by 472 days.

(21) Appl. No.: 09/897,757

(22) Filed: Jul. 3, 2001

(65) Prior Publication Data

US 2003/0209467 A1 Nov. 13, 2003

Related U.S. Application Data

(60) Provisional application No. 60/250,135, filed on Dec. 1, 2000.

(30) Foreign Application Priority Data

Jul. 6, 2000 (FR) ..... 00 08860

(51) Int. Cl.[7] ..... C10G 45/00

(52) U.S. Cl. ..... 208/210; 208/211; 208/82; 208/216 R; 208/217; 208/218; 208/208 R; 208/209; 208/213; 208/88; 208/89

(58) Field of Search ..... 208/210, 211, 208/82, 216 R, 217, 218, 208 R, 209, 213, 88, 89

(56) References Cited

U.S. PATENT DOCUMENTS

| | | | | | |
|---|---|---|---|---|---|
| 4,442,223 | A | * | 4/1984 | Chester et al. | 502/68 |
| 4,925,549 | A | * | 5/1990 | Robinson et al. | 208/65 |
| 5,114,562 | A | * | 5/1992 | Haun et al. | 208/89 |
| 6,083,378 | A | * | 7/2000 | Gildert et al. | 208/209 |
| 6,303,020 | B1 | * | 10/2001 | Podrebarac et al. | 208/210 |
| 6,334,948 | B1 | * | 1/2002 | Didillon et al. | 208/218 |
| 6,444,118 | B1 | * | 9/2002 | Podrebarac et al. | 208/210 |

FOREIGN PATENT DOCUMENTS

| | | | | |
|---|---|---|---|---|
| EP | 0 419 266 | A1 * | 3/1991 | 45/16 |
| EP | 0 755 995 | | 1/1997 | |
| EP | 0 870 817 | | 10/1998 | |
| WO | 94 22980 | | 10/1994 | |
| WO | 97 03150 | | 10/1997 | |
| WO | 98 07805 | | 2/1998 | |

* cited by examiner

*Primary Examiner*—Walter D. Griffin
(74) *Attorney, Agent, or Firm*—Millen, White, Zelano & Branigan, P.C.

(57) ABSTRACT

The invention relates to a process for the production of gasoline with a low sulfur content comprising at least three stages: a first stage in which the sulfur-containing compounds present in the gasoline are at least partially transformed into H2S and into saturated sulfur-containing compounds; a second stage whose purpose is to eliminate the H2S from the gasoline produced in the first stage; and a third stage in which the saturated sulfur-containing compounds remaining in the gasoline are transformed into H2S. The process according to the invention optionally also comprises a pretreatment stage whose purpose is to hydrogenate the diolefins of the feedstock before the first stage.

20 Claims, No Drawings

PROCESS COMPRISING TWO GASOLINE HYDRODESULFURIZATION STAGES AND INTERMEDIATE ELIMINATION OF H2S FORMED DURING THE FIRST STAGE

This appln claims benefit of Ser. No. 60/250,135 filed Dec. 1, 2000.

This invention relates to a process for the production of gasolines with a low sulfur content, which makes it possible to upgrade the entire sulfur-containing gasoline fraction, to reduce the total sulfur contents of said gasoline fraction to very low levels, without significant reduction of the gasoline yield and by minimizing the reduction of the octane number caused by the hydrogenation of the olefins. This process applies in particular when the gasoline to be treated is a catalytic cracking gasoline that contains a sulfur content that is greater than 1000 ppm by weight and/or an olefin content that is greater than 30% by weight, when the desired sulfur content in the desulfurized gasoline is less than 50 ppm by weight.

PRIOR ART

The specifications on the fuels, whose purpose is to reduce the emissions of pollutants, have been made much tougher for several years. This tendency runs the risk of continuing in the years to come. As far as the gasolines are concerned, the most strict specifications concern in particular the content of olefins, benzene and sulfur.

The cracking gasolines, which represent 30 to 50% of the gasoline pool, present the drawback of containing large sulfur concentrations, which causes the sulfur that is present in the reformulated gasolines to be nearly 90% attributed to the cracking gasolines (catalytic cracking gasolines in a fluidized bed or FCC, steam-cracking gasoline, coking gasolines, . . . ). The desulfurization (hydrodesulfurization) of gasolines and primarily cracking gasolines is therefore of obvious importance for achieving the specifications.

These gasolines contain olefins, however, that contribute significantly to the octane of the reformulated gasoline, and it is thus desirable to reduce or to monitor their saturation during desulfurization treatments to reduce the octane losses that result therefrom.

Much research has been conducted in recent years to propose processes or catalysts that make it possible to desulfurize the gasolines by attempting to reduce the olefin losses caused by hydrogenation. This work has led to the emergence of a certain number of processes, some of which are marketed today and which are able to reduce the hydrogenation rate of the olefins while making it possible to attain desulfurization rates that are required for attaining the specifications in force.

The specifications to come will be tightened up, however, i.e., they will impose sulfur specifications that are even more strict. Consequently, there is a continual need to use catalysts or processes that make it possible to attain even lower sulfur contents while preserving the olefins even for cracking gasolines that can contain high sulfur contents, i.e., contents that are greater than 1000 ppm by weight and/or for gasolines that contain high olefin contents (greater than 30% by weight relative to the initial gasoline).

Patent Application EP-A-0 725 126 describes a process for hydrodesulfurization of a cracking gasoline in which the gasoline is separated by a number of fractions comprising at least a first fraction rich in compounds that are easy to desulfurize and a second fraction that in compounds that are difficult to desulfurize. Before carrying out this separation, it is necessary first of all to determine the distribution of sulfur-containing products using analyses.

French Patent Application 99/02,336 describes a 2-stage hydrodesulfurization process, a stage for hydrogenation of unsaturated sulfur-containing compounds, and a stage for decomposition of saturated sulfur-containing compounds. There is no elimination of H2S that is present or formed between these two stages.

SUMMARY OF THE INVENTION

This invention relates to a three-stage process for desulfurization of gasolines. This process is particularly well suited to cracking gasolines that have a sulfur content that is greater than 1000 ppm by weight that it is desired to reduce to a level less than 50 ppm by weight and preferably less than 15 ppm by weight.

The process according to the invention comprises at least three stages:

A) A first stage in which the sulfur-containing compounds present in the gasoline are at least partially transformed into H2S and into saturated sulfur-containing compounds.

B) A second stage whose purpose is to eliminate H2S from the gasoline produced in stage A);

C) A third stage in which the saturated sulfur-containing compounds remaining in the gasoline are transformed into H2S.

It also optionally and preferably comprises a stage for selective hydrogenation of compounds that are dienes and optionally acetylenes, located before stage A.

This invention therefore relates to a process for the production of gasolines with a low sulfur content, which makes it possible to upgrade the entire gasoline fraction that contains sulfur and olefins, to reduce the sulfur contents in said gasoline fraction to very low levels and generally to a value that is less than 50 ppm, even less than 15 ppm by weight, without a significant reduction of the gasoline yield, and by minimizing the reduction of the octane number caused by the hydrogenation of the olefins. The process is particularly suited for the treatment of gasolines that have a high sulfur content, i.e., a sulfur content that is greater than 1000 ppm by weight and/or when the gasoline has a high olefin content, i.e., greater than 30% by weight.

The process according to the invention comprises a treatment of the feedstock on a first catalyst allowing to hydrogenate at least partially the aromatic sulfur-containing compounds such as, for example, the thiophenic compounds, by being placed under conditions where the hydrogenation of the olefins is limited with this catalyst (stage A), a stage allowing to eliminate at least in part the H2S from the thus treated gasoline (stage B), then a third treatment on at least one catalyst allowing to decompose at least in part the saturated sulfur-containing compounds with a limited hydrogenation of olefins (stage C).

In some cases, it is possible to consider that stage C is carried out on a catalyst sequence, for example the sequence that is described in patent application Ser. No. 99/02,336 while meeting the criteria that relate to the H2S concentration at the inlet of the third stage according to this invention.

The feedstock of the process according to the invention is a gasoline fraction that contains sulfur and olefins, preferably a gasoline fraction that is obtained from a cracking unit, and preferably a gasoline that is obtained for the most part from a catalytic cracking unit. The treated gasoline can also be a gasoline mixture that is obtained from various conversion processes, such as the processes for steam-cracking, coking or visbreaking (according to English terminology), even gasolines that are directly obtained from the distillation of petroleum products. The gasolines that have large olefin concentrations are particularly suitable for being subjected to the process according to the invention.

DETAILED DESCRIPTION OF THE INVENTION

It was described in patent application Ser. No. 99/02,336 that the combination of two catalysts that are suitable for the hydrotreatment of catalytic cracking gasolines, whereby one of said catalysts allows to transform the unsaturated sulfur compounds that are present in the gasoline, such as, for example, the thiophenic compounds, and the other allows to transform selectively the saturated sulfur compounds which are already present in the gasoline or are produced during the first stage of the treatment of the gasoline, allows to obtain a desulfurized gasoline that does not have a significant reduction of the olefin content or the octane number. It has now been discovered, and this is the object of this invention, that it was possible to obtain a higher level of performance of the process, mainly when the sulfur content of the gasoline is high, i.e., greater than 1000 ppm by weight and/or when the olefin content is greater than 30% by weight, and that the sulfur content of said gasoline is less than 50 ppm by weight, even less than 15 ppm by weight.

The sulfur-containing radicals contained in the feedstocks which are treated by the process of the invention can be mercaptans or heterocyclic compounds, such as, for example, thiophenes or alkyl-thiophenes, or heavier compounds, such as, for example, benzothiophene or dibenzothiophene. These heterocyclic compounds, contrary to mercaptans, cannot be eliminated by the conventional extracting processes. These sulfur-containing compounds are consequently eliminated by the process according to the invention that leads to their at least partial decomposition into hydrocarbons and H2S.

The sulfur content of the gasoline fractions produced by catalytic cracking (FCC) depends on the sulfur content of the feedstock that is treated with FCC, as well as the end point of the fraction. Generally, the sulfur contents of an entire gasoline fraction, in particular those that are obtained from FCC, are greater than 100 ppm by weight and most of the time greater than 500 ppm by weight. For gasolines that have end points that are greater than 200° C., the sulfur contents are often greater than 1000 ppm by weight, and they can even in some cases reach values on the order of 4000 to 5000 ppm by weight.

The gasolines that are particularly suitable for the process according to the invention therefore contain olefin concentrations that are generally between 5 and 60% by weight. When the gasoline contains a sulfur content that is less than 1000 ppm, the treated gasoline in the process according to the invention preferably contains more than 30% by weight of olefins.

The gasolines can also contain significant concentrations of diolefins, i.e., diolefin concentrations that may be up to 15% by weight. Generally, the diolefin content is between 0.1 and 10% by weight. When the diolefin content is greater than 1% by weight, even greater than 0.5% by weight, the gasoline can, before undergoing stages A, B and C of the process according to the invention, be subjected to a selective hydrogenation treatment whose purpose is to hydrogenate at least in part the diolefins that are present in said gasoline.

The gasoline can also contain nitrogen-containing compounds in a natural way. The nitrogen concentration of the gasoline is generally less than 1000 ppm by weight and is generally between 20 and 500 ppm by weight.

This gasoline preferably contains a sulfur content that is greater than 1000 ppm by weight. The range of boiling points typically extends from about the boiling points of hydrocarbons with 5 carbon atoms (C5) up to about 250° C. The end point of the gasoline fraction depends on the refinery from which it is obtained as well as market constraints but generally remains within the limits that are indicated above. In some cases, to optimize the configuration of the process, it may be advantageous to subject the gasoline to various treatments before subjecting it to the process according to the invention. The gasoline can, for example, undergo fractionations or any other treatment before being subjected to the process according to the invention without these treatments limiting the scope of the invention.

For this type of gasoline, the analysis of the nature of the sulfur-containing compounds shows that the sulfur is essentially present in the form of thiophenic compounds (thiophene, methylthiophenes, alkylthiophenes, . . . ), and, based on the end point of the gasoline that is to be treated, benzothiophenic compounds, alkybenzothiophenic compounds, even compounds that are derived from dibenzothiophene.

The process according to the invention first of all comprises a treatment (stage A) of the gasoline on a catalyst allowing to hydrogenate at least in part unsaturated sulfur-containing compounds such as, for example, the thiophenic compounds, into saturated compounds such as, for example, the thiophanes (or thiacyclopentane) or into mercaptans according to a succession of reactions described below:

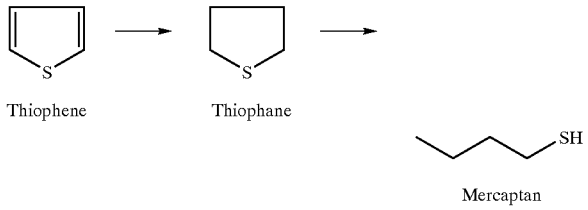

This hydrogenation reaction can be carried out on a conventional hydrotreatment (hydrodesulfurization) catalyst comprising a metal of group VIII and a metal of group VIb in part in sulfide form. When such a catalyst is used, the operating conditions are adjusted to be able to hydrogenate at least in part the thiophenic compounds while limiting the hydrogenation of olefins.

During this stage, the thiophenic compounds, benzothiophenic compounds and dibenzothiophenic compounds, if they are present in the gasoline to be treated, are generally transformed in a significant way, i.e., at the end of the first stage, the content of thiophenic compounds, benzothiophenic compounds or dibenzothiophenic compounds represents at most 20% of that of the initial gasoline. In addition, this hydrogenation stage is accompanied by the significant production of H2S by total decomposition of the sulfur-containing compounds that are initially present in the feedstock. The decomposition rate of the sulfur-containing compounds that are present in the H2S feedstock, which accompanies the hydrogenation of unsaturated sulfur-containing compounds, is generally greater than 50%.

The process according to the invention comprises a second stage where H2S is at least in part eliminated from the effluent that is obtained at the end of stage A. This stage can be carried out with any techniques that are known to one skilled in the art. It can be carried out directly under the conditions in which the effluent is found at the end of stage A or after these conditions had been changed to facilitate the elimination of at least a portion of the H2S. As a conceivable technique, it is possible to cite, for example, a gas/liquid separation (where the gas is concentrated with H2S and the liquid is low in H2S and is sent directly to stage C), a stage for stripping the gasoline that is practiced on a liquid fraction of the gasoline obtained after stage A, an amine washing stage, also practiced there on a liquid fraction of the gasoline that is obtained after stage A, a collection of H2S by an absorbent mass that operates on the gaseous or liquid effluent obtained after the stage, a separation of H2S from the gaseous or liquid effluent by a membrane. At the end of this treatment, the sulfur content in H2S form is generally less than 500 ppm by weight relative to the initial gasoline. This content is preferably brought, at the end of stage B, to a value of between 0.2 and 300 ppm by weight and even more preferably to a value of between 0.5 and 150 ppm by weight.

The process according to the invention comprises a third stage (stage C) in which the sulfur-containing saturated compounds are converted into H2S according to the reactions:

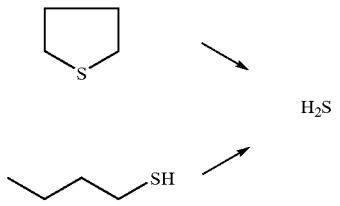

This treatment can be carried out with any catalyst allowing the conversion of saturated sulfur compounds (primarily the compounds of thiophane type or mercaptan type). It can be carried out, for example, by using a catalyst with a base of nickel, molybdenum, cobalt, tungsten, iron or tin. The treatment is preferably carried out in the presence of a catalyst with a base of nickel, nickel and tin, cobalt and iron, or cobalt and tungsten.

The thus desulfurized gasoline is then optionally stripped to eliminate the H2S that is produced during stage C.

Relative to the invention that is described in patent application Ser. No. 99/02,336, the invention proposed here offers as an advantage:

- to be able to reach higher desulfurization rates of the gasoline, i.e., much lower residual sulfur contents in particular when the gasoline to be treated has a high sulfur content, i.e., a sulfur content that is greater than 1000 ppm and/or an olefin content that is greater than 30% by weight;
- to operate stage C under much milder temperature conditions, which offers advantages at the level of the process in particular by allowing improved thermal integration between the reaction section of stage A and stage C.

In the case of gasoline with a high sulfur content and/or when the rate of transformation of the unsaturated sulfur-containing compounds into saturated sulfur-containing compounds is not adequate in stage A, it may be advantageous to carry out stage C with a catalyst sequence comprising at least one catalyst that is described for stage A and at least one catalyst that is described for stage C.

The stages of the process according to the invention are described in more detail below.

Hydrogenation of the Dienes (Optional Stage Before Stage A)

The hydrogenation of the dienes is an optional but advantageous stage allowing to eliminate, before hydrodesulfurization, almost all of the dienes present in the gasoline fraction that contains the sulfur to be treated. It generally takes place in the presence of a catalyst comprising at least one metal of group VIII, preferably selected in the group consisting of platinum, palladium and nickel, and a substrate. For example, a catalyst with a nickel base deposited on an inert substrate, such as, for example, alumina, silica or a substrate that contains at least 50% alumina, will be used. This catalyst operates under a pressure of 0.4 to 5 MPa, at a temperature of 50 to 250° C., with an hourly space velocity of the liquid of 1 to 10 $h^{-1}$. Another metal can be combined to form a bimetallic catalyst, such as, for example, molybdenum or tungsten.

It may be particularly advantageous, primarily when fractions are treated whose boiling point is less than 160° C., to operate under conditions such that an at least partial softening of the gasoline is obtained, i.e., a certain reduction of the mercaptan content. To do this, it is possible to use the procedure that is described in Patent Application FR-A-2 753 717, which uses a catalyst with a palladium base.

The selection of the operating conditions is particularly important. Most generally the operation will be carried out under pressure in the presence of an amount of hydrogen that is in light excess relative to the stoichiometric value that is necessary for hydrogenating the diolefins. The hydrogen and the feedstock to be treated are injected in upflow or downflow mode in a reactor preferably with a fixed catalyst bed. The temperature is most generally between about 50 and about 250° C., and preferably between 80 and 230° C., and more preferably between 120 and 200° C.

The pressure is adequate to maintain more than 80%, and preferably more than 95% by weight of the gasoline to be treated in liquid phase in the reactor; it is most generally between 0.4 and 5 MPa and preferably greater than 1 MPa. The pressure is advantageously between 1 and 4 MPa. The volumetric flow rate is between about 1 and about 10 $h^{-1}$, preferably between 4 and 10 $h^{-1}$.

The catalytic cracking gasoline can contain up to several % by weight of diolefins. After hydrogenation, the diolefin content is generally reduced to less than 3000 ppm, even less than 2500 ppm, and more preferably less than 1500 ppm. In some cases, less than 500 ppm may be obtained. The content of dienes after selective hydrogenation can even, if necessary, be reduced to less than 250 ppm.

According to an embodiment of the invention, the diene hydrogenation stage takes place in a hydrogenation catalytic reactor that comprises a catalytic reaction zone that is traversed by the entire feedstock and the necessary amount of hydrogen to carry out the desired reactions.

Hydrogenation of the Unsaturated Sulfur Compounds (Stage A)

This stage consists in transforming at least a portion of the unsaturated sulfur compounds, such as the thiophenic compounds, into saturated compounds, for example into thiophanes (or thiacyclopentanes) or into mercaptans.

This stage can be carried out, for example, by sending the feedstock to be treated, in the presence of hydrogen, over a catalyst containing at least one element of group VIII and/or at least one element of group VIb at least in part in sulfide form, at a temperature of between about 210° C. and about 350° C., preferably between 220° C. and 320° C. and more preferably between 220° C. and 290° C., under a pressure of generally between about 1 and about 5 MPa, preferably between 1 and 4 MPa and more preferably between 1.5 and 3 MPa. The volumetric flow rate of the liquid is between about 1 and about 10 $h^{-1}$ (expressed by volume of liquid per volume of catalyst and per hour), preferably between 3 $h^{-1}$ and 8 $h^{-1}$. The $H_2$/HC ratio is between 100 to 600 liters per liter and preferably 300 to 600 liters per liter.

To carry out, at least in part, the hydrogenation of the unsaturated sulfur-containing compounds of the gasoline according to the process of the invention, generally at least one hydrodesulfurization catalyst, comprising at least one element of group VIII (metals of groups 8, 9 and 10 of the new classification, i.e., iron, ruthenium, osmium, cobalt, rhodium, iridium, nickel, palladium or platinum) and/or at least one element of group VIb (metals of group 6 of the new classification, i.e., chromium, molybdenum or tungsten) is/are used on a suitable support. Preferably, the element of group VIII, when it is present, is generally nickel or cobalt, and the element of group VIb, when it is present, is generally molybdenum or tungsten. Combinations such as nickel-molybdenum or cobalt-molybdenum are preferred. The catalyst support is usually a porous solid, such as, for example, an alumina, a silica-alumina or other porous solids, such as, for example, magnesia, silica or titanium oxide, alone or mixed with alumina or silica-alumina.

After introduction of the element or elements and optionally shaping the catalyst (when this stage is carried out on a mixture that already contains the basic elements), the catalyst is in a first activated stage. This activation may correspond either to an oxidation, then to a reduction, or to a direct reduction, or to a calcination only. The calcination stage is generally carried out at temperatures that range from about 100 to about 600° C. and preferably between 200 and 450° C., under an air flow.

The catalyst that is preferably used in this stage is a catalyst that comprises an alumina-based substrate whose specific surface area is less than 200 m2/g and that comprises at least one element that is selected from the group that consists of cobalt, molybdenum, nickel or tungsten, and preferably selected from the group that consists of cobalt, molybdenum and tungsten. Even more preferably, the catalyst according to the invention contains at least cobalt and molybdenum. In addition, the molybdenum content, when this element is present, is preferably greater than 10% by weight expressed in molybdenum oxide, the cobalt content, when this element is present, is preferably greater than 1% by weight (expressed in cobalt II oxide). For the molybdenum-based catalysts, the molybdenum density in the catalyst, expressed by gram of MoO3 per square meter of substrate, is greater than 0.05 $g/m^2$ of substrate.

The reduction stage is carried out under conditions that make it possible to convert at least a portion of the oxidized forms from base metal into metal. Generally, they consist in treating the catalyst under a hydrogen flow at a temperature that is at least equal to 300° C. The reduction can also be carried out in part with chemical reducing agents.

The catalyst is preferably used at least in part in its sulfurized form. The introduction of the sulfur can take place between different activation stages. Preferably, no oxidation stage is carried out when the sulfur or a sulfur-containing compound is introduced onto the catalyst. The sulfur or a sulfur-containing compound can be introduced ex situ, i.e., outside of the reactor where the process according to the invention is carried out, or in situ, i.e., in the reactor that is used for the process according to the invention. In the latter case, the catalyst is preferably reduced under the above-described conditions, then sulfurized by passage of a feedstock that contains at least one sulfur-containing compound, which once decomposed leads to the attachment of sulfur to the catalyst. This feedstock can be gaseous or liquid, for example the hydrogen that contains $H_2S$, or a liquid that contains at least one sulfur-containing compound.

The sulfur-containing compound is preferably added to the catalyst ex situ. For example, after the calcination stage, a sulfur-containing compound can be introduced onto the catalyst optionally in the presence of another compound. The catalyst is then dried, then transferred into the reactor that is used to implement the process of the invention. In this reactor, the catalyst is then treated under hydrogen so as to transform at least a portion of the main metal into sulfide. A procedure that is particularly suitable for the invention is the one that is described in Patents FR-B-2 708 596 and FR-B-2 708 597.

In the process according to the invention, the conversion of the unsaturated sulfur-containing compounds is greater than 15% and preferably greater than 50%. In the same step, the hydrogenation rate of the olefins is preferably less than 50% and preferably less than 40% during this stage.

The effluent that underwent this first treatment is then sent to stage B that makes it possible to eliminate at least in part the H2S that is present at the end of stage A.

Elimination of the H2S from the Effluent of Stage A (Stage B)

In this stage, the H2S concentration is reduced. The elimination of H2S can be carried out in various manners for the most part known to one skilled in the art. It is possible, for example, to cite the adsorption of a portion of the H2S that is contained in the effluent of stage A by an absorbent mass with a metallic oxide base, preferably selected from the group that consists of zinc oxide, copper oxide or molybdenum oxide. This adsorbent mass can preferably be regenerated. Its regeneration can be carried out continuously or intermittently, for example, using a thermal treatment under an oxidizing or reducing atmosphere. The absorbent mass can be used in a fixed bed or in a moving bed. It can operate directly on the effluent of stage A, or on this effluent that has undergone treatments (for example, a cooling or a separation . . . ). Another method consists in carrying out a membrane separation of H2S by using a selective membrane that operates on a liquid or gaseous effluent that is obtained from stage A. One of the zones of the separation can contain an absorbent mass so as to promote the transfer of H2S through the wall of the membrane. Another method may consist in cooling the effluent of stage A and in producing an H2S-rich gas and a liquid phase that is low in H2S. The gas phase can then be treated in an amine washing unit. The liquid phase and the gas phase can then be remixed and sent to stage C. The liquid fraction can furthermore undergo other treatments such as a stripping with hydrogen, nitrogen or water vapor, an extraction of H2S, a washing with amines, a washing by a soda solution so as to reduce its H2S content.

Decomposition of the Saturated Compounds of the Sulfur (Stage C)

In this stage, the saturated sulfur compounds are transformed in the presence of hydrogen into a suitable catalyst. This transformation is carried out without hydrogenation of the olefins, i.e., during this stage, the hydrogenation of the olefins is limited to 20% relative to the initial gasoline content and preferably limited to 10% relative to the olefin concentration of the gasoline.

The catalysts that can be suitable for the invention, without this list being limiting, are catalysts that comprise at least one metal selected in the group consisting of nickel, cobalt, iron, molybdenum and tungsten. More preferably, the catalysts of this stage are nickel based. These metals are preferably supported and used in their sulfurized form.

The metal content of the catalyst that is used according to the invention is generally between about 1 and about 60% by weight and preferably between 5 and 20% by weight. Preferably, the catalyst is generally preferably worked into the shape of balls, extrudates, pellets or trilobes. The metal can be incorporated in the catalyst in the preformed support; it can also be mixed with the support before the shaping stage. The metal is generally introduced in the form of a precursor salt, generally water-soluble, such as, for example, the nitrates or heptamolybdates. This method of introduction is not specific to the invention. Any other method of introduction that is known to one skilled in the art is suitable for the implementation of the invention.

The catalysts support used in the process of the invention are generally porous solids that are selected among refractory oxides, such as, for example, aluminas, silicas and silica-aluminas, magnesia, as well as titanium oxide and zinc oxide, these last oxides can be used alone or mixed with alumina or silica-alumina. The support are preferably transition aluminas or silicas whose specific surface area is between 25 and 350 $m^2/g$. The natural compounds (for example diatomaceous earth or kaolin) can also be suitable as support for the catalysts of the process according to the invention.

After introduction of the metal and optionally shaping of the catalyst (when this stage is carried out with a mixture that already contains base metal), the catalyst is in a first activated stage. This activation can correspond either to an oxidation, then to a reduction, or to a direct reduction, or to a calcination only. The calcination stage is generally carried out at temperatures ranging from about 100 to about 600° C. and preferably between 200 and 450° C. under an air flow. The reduction stage is carried out under conditions allowing to convert at least a portion of the oxidized forms of the base metal into metal. Generally, they consist in treating the catalyst under a hydrogen flow at a temperature that is at least equal to 300° C. The reduction can also be carried out in part with chemical reducing agents.

The catalyst is preferably used at least in part in its sulfurized form. This offers the advantage of limiting as much as possible the hydrogenation risks of the unsaturated compounds such as the olefins or the aromatic compounds during the start-up phase. The introduction of sulfur can take place between various activation stages. Preferably, no oxidation stage is carried out when the sulfur or a sulfur-containing compound is introduced onto the catalyst. The sulfur or a sulfur-containing compound can be introduced ex situ, i.e., outside of the reactor where the process according to the invention is carried out, or in situ, i.e., in the reactor that is used for the process according to the invention. In the latter case, the catalyst is preferably reduced under the conditions described above, then sulfurized by passing a feedstock containing at least one sulfur-containing compound, which once decomposed leads to the attachment of sulfur to the catalyst. This feedstock can be gaseous or liquid, for example hydrogen containing $H_2S$ or a liquid that contains at least one sulfur-containing compound.

The sulfur-containing compound is preferably added to the catalyst ex situ. For example, after the calcination stage, a sulfur-containing compound can be introduced onto the catalyst optionally in the presence of another compound. The catalyst is then dried, then transferred into the reactor that is used to implement the process according to the invention. In this reactor, the catalyst is then treated under hydrogen so as to transform at least a portion of the main metal into sulfide. A procedure that is particularly suitable to the invention is the one that is described in Patents FR-B-2 708 596 and FR-B-2 708 597.

After sulfurization, the sulfur content of the catalyst is in general between 0.5 and 25% by weight, preferably between 4 and 20% by weight.

The purpose of the hydrotreatment that is carried out during this stage is to convert into $H_2S$ the saturated sulfur-containing compounds of the gasoline that already underwent a prior treatment so as to obtain an effluent that will meet the desired specifications in terms of content of sulfur-containing compounds. The gasoline thus obtained has a slightly lower octane number, because of the partial, but inevitable, saturation of the olefins, than the one of the gasoline to be treated. This saturation, however, is limited.

The operating conditions of the catalyst allowing to decompose the saturated sulfur compounds into H2S should be adjusted so as to reach the desired hydrodesulfurization rate and so as to reduce the octane loss which results from the saturation of olefins. The second catalyst (catalyst of stage C) that is used in the process according to the invention generally allows to convert only at most 20% of the olefins, preferably at most 10% of the olefins.

The treatment whose purpose is to decompose the saturated sulfur-containing compounds during the first stage of the process (stage A) is carried out in the presence of hydrogen, with the catalyst based on a metal, such as more preferably nickel, at a temperature of between about 200° C. and about 350° C., preferably between 250° C. and 350° C., more preferably between 260° C. and 320° C., under a low to moderate pressure generally of between about 0.5 and about 5 MPa, preferably between 0.5 MPa and 3 MPa, more preferably between 1 and 3 MPa. The liquid volumetric flow rate is generally between about 0.5 and about 10 $h^{-1}$ (expressed by volume of liquid per volume of catalyst and per hour), preferably between 1 and 8 $h^{-1}$. The $H_2$/HC ratio is adjusted based on the desired hydrodesulfurization rates in the range that is generally between about 100 and about 600 liters per liter, preferably between 100 and 300 liters per liter. All or part of this hydrogen can be obtained from stage A or a recycling of the unconsumed hydrogen obtained from stage C.

Implementation of the Process

One of the possibilities of implementation of the process according to the invention can consist in, for example, passing the gasoline that is to be hydrotreated through a reactor that contains a catalyst allowing, at least in part, the hydrogenation of the unsaturated sulfur-containing compounds, such as, for example, the thiophenic compounds, into saturated sulfur compounds (stage A) and the elimination of H2S (stage B), then through a reactor that contains a catalyst allowing to decompose the saturated sulfur compounds into H2S (stage C). The stage for elimination of H2S can also be carried out in the reactor of stage C or else a part in each of the 2 reactors. The elimination stage can also be partly or entirely located outside of the reactors of stages A and C.

In another configuration that is also suitable, the two catalysts of stages A and C are placed in a series in the same reactor, and an adsorbent mass of H2S is placed between the two catalysts to eliminate at least in part the H2S produced in the first catalytic zone (stage B). In such a configuration, the absorbent mass, once saturated with H2S, can either be replaced or regenerated. In the latter case, the regeneration can be carried out intermittently or continuously based on the adsorbent mass that is used.

In all of the cases, the two catalytic zones can operate under different conditions of pressure, VVH, temperature, and H2/feedstock ratio. Systems can be implanted so as to dissociate the operating conditions of the two reaction zones.

It can also be considered to carry out a sequence that consists in passing the gasoline that is to be hydrotreated through a reactor that contains a catalyst allowing, at least in part, the hydrogenation of unsaturated sulfur-containing compounds into saturated sulfur compounds (stage A), then to carry out separately or simultaneously a stage for elimination of H2S, then to carry out stage C in a reactor that contains a sequence of catalysts comprising at least one catalyst of the same type as the one that is used in the first stage of the process (stage A) and at least one catalyst allowing to decompose the saturated sulfur compounds into H2S (stage C).

With the sequences proposed for the process according to the invention, it is possible to reach high hydrodesulfurization rates while limiting the loss of olefins and consequently the reduction of the octane number.

The examples below illustrate the invention without limiting its scope.

EXAMPLE 1

Pretreatment of the Feedstock by Selective Hydrogenation

Table 1 offers the characteristics of the feedstock (catalytic cracking gasolines) treated by the process according to the invention. The analytical methods used to characterize the feedstocks and effluents are as follows:

- gas phase chromatography (CPG) for the hydrocarbon-containing components;
- method NF M 07052 for the total sulfur;
- method NF EN 25164/M 07026-2/ISO 5164/ASTM D 2699 for the research octane number;
- method NF EN 25163/M 07026-1/ISO 5163/ASTM D 2700 for the motor octane number.

TABLE 1

Characteristics of the Feedstock Used

| | Feedstock |
|---|---|
| Density | 0.78 |
| Starting point (° C.) | 63° C. |
| End point (° C.) | 250° C. |
| Olefins content (% by weight) | 31.3 |
| Dienes content | 1.4 |
| S total (ppm) | 2062 |
| RON | 91 |
| MON | 80 |
| (RON + MON)/2 | 85.5 |

This feedstock is pretreated using a selective hydrogenation stage. The hydrogenation of the diolefins is carried out on a catalyst HR945$^{(R)}$ that is based on nickel and molybdenum, marketed by the Procatalyse Company. The test is carried out in a continuous reactor of the flushed-bed type, whereby the feedstock and the hydrogen are introduced via the bottom of the reactor. 60 ml of catalyst is introduced into the reactor after having first been sulfurized ex situ for 4 hours, under a pressure of 3.4 MPa, at 350° C., upon contact with a feedstock that consists of 2% by weight of sulfur in the form of dimethyl disulfide in n-heptane. The catalyst is then transferred into the reactor where the hydrogenation of the diolefins is carried out. The hydrogenation is then carried out under the following conditions: T=190° C., P=2.7 MPa, VVH=6h-1, and H2/HC=151/1. After diolefins are hydrogenated, the diolefin content is 0.1% by weight.

EXAMPLE 2

Hydrodesulfurization of the Hydrogenated Gasoline According to Stage A (For Comparison)

The hydrogenated gasoline is hydrodesulfurized under the conditions of Example 1.

A catalyst A is obtained by impregnation "without excess solution" of a transition alumina that comes in the form of beads with a specific surface area of 130 $m^2/g$ and a pore volume of 0.9 ml/g, by an aqueous solution that contains molybdenum and cobalt in the form of ammonium heptamolybdate and cobalt nitrate. The catalyst is then dried and calcined under air at 500° C. The content of cobalt and molybdenum of this sample is 3% of CoO and 10% of MoO3.

25 ml of catalyst A is placed in a tubular fixed-bed hydrodesulfurization reactor. The catalyst is first sulfurized by treatment for 4 hours under a pressure of 3.4 MPa at 350° C. upon contact with a feedstock that consists of 2% of sulfur in the form of dimethyl disulfide in n-heptane.

The operating conditions of the hydrodesulfurization are as follows: VVH=4 $h^{-1}$ (VVH=volume of the feedstock treated per hour and per volume of catalyst), $H_2$/HC=360 l/l, P=2.0 MPa. The temperature of the catalytic zone is between 280° C. and 320° C. The results that are obtained are presented in Table 2.

TABLE 2

| Temperature of the Catalytic Zone (° C.) | Sulfur Content of the Desulfurized Gasoline (ppm) | Olefin Content of the Desulfurized Gasoline (% by Weight) | Octane of the Desulfurized Gasoline (RON + MON)/2 |
|---|---|---|---|
| 280° C. | 184 | 23.9 | 83.5 |
| 300° C. | 90 | 20.2 | 82.4 |
| 305° C. | 50 | 17.1 | 80.4 |
| 320° C. | 12 | 13.6 | 76.5 |

EXAMPLE 3

Hydrodesulfurization According to Stages A and C (For Comparison)

The gasoline that is hydrogenated under the conditions of Example 1 is hydrodesulfurized. A second catalyst (catalyst C) is prepared from a transition alumina of 140 $m^2/g$ that comes in the form of beads with a 2 mm diameter. The pore volume is 1 ml/g of support. 1 kilogram of the support is impregnated by 1 liter of nickel nitrate solution. The catalyst is then dried at 120° C. and calcined under a stream of air at 400° C. for one hour. The nickel content of the catalyst is 20% by weight. 25 ml of catalyst A of Example 1 and 50 ml of catalyst C are placed in the same hydrodesulfurization reactor so that the feedstock to be treated (heavy fraction) first meets catalyst A and then catalyst C. The catalysts are first sulfurized by treatment for 4 hours under a pressure of 3.4 MPa at 350° C. upon contact with a feedstock that consists of 2% of sulfur in the form of dimethyl disulfide in n-heptane.

The operating conditions of the hydrodesulfurization are as follows: VVH=1.33 $h^{-1}$ relative to the entire catalytic bed $H_2$/HC=360 l/l, P=2.0 MPa. The temperature of the catalytic zone that comprises catalyst A is 250° C. to 290° C., and the temperature of the catalytic zone that contains catalyst C is 330° C.

The results that are obtained under these conditions are recorded in Table 3.

TABLE 3

| Temperature of Catalytic Zone A (° C.) | Sulfur Content of the Desulfurized Gasoline (ppm) | Olefin Content of the Desulfurized Gasoline (% by Weight) | Octane of the Desulfurized Gasoline (RON + MON)/2 |
|---|---|---|---|
| 270° | 50 | 20.4 | 82.3 |
| 290° C. | 13 | 15.6 | 78.7 |

EXAMPLE 4

Hydrodesulfurization According to Stages A, B and C of the Process According to the Invention The gasoline that is hydrogenated under the conditions of Example 1 is hydrodesulfurized. A test is performed under the same conditions as those of Example 3, if it is only that the two catalysts are placed in two different reactors and that H2S is separated between these two reactors. The effluent of the first reactor is cooled to ambient temperature, and the liquid phase and the gaseous phase are separated; H2S of the liquid phase is stripped by a nitrogen stream that makes it possible to eliminate H2S to a content of 50 ppm by weight relative to the liquid. The liquid that is thus obtained is then reheated to the temperature of the second catalyst and reinjected in the presence of hydrogen that is introduced with a hydrogen flow rate of 330 1/1 of feedstock that corresponds approximately to the flow rate of hydrogen entering the second catalytic zone of Example 3.

The sulfurization conditions and the test conditions correspond to those of Example 3.

The results that are obtained under these conditions are recorded in Table 4.

TABLE 4

| Temperature of Catalytic Zone A (° C.) | Sulfur Content of the Desulfurized Gasoline (ppm) | Olefin Content of the Desulfurized Gasoline (% by Weight) | Octane of the Desulfurized Gasoline (RON + MON)/2 |
|---|---|---|---|
| 260° C. | 48 | 21.3 | 82.5 |
| 280° C. | 12 | 16.2 | 79.4 |

EXAMPLE 5

Another Hydrodesulfurization Method According to Stages A, B and C of the Process According to the Invention The gasoline hydrogenated under conditions of Example 1 is hydrosulfurized. 25 ml of catalyst A is placed in a tubular reactor. This reactor is coupled with a second hydrodesulfurization reactor containing 13 ml of catalyst A of Example 1 and 25 ml of catalyst C of Example 3, so that the feedstock first meets catalyst A and then catalyst C. The effluent of the first reactor is cooled to ambient temperature, the liquid phase and the gaseous phase are separated, and the H2S of the liquid phase is stripped by a nitrogen stream allowing to eliminate H2S to a content of 50 ppm by weight relative to the liquid. The liquid thus obtained is then reheated to the temperature of the second reactor and reinjected in the presence of hydrogen introduced with a flow rate and under a pressure corresponding to that of the second reactor of Example 4. The temperature of the first reactor is indicated in Table 5. The temperature of catalyst A that is present in the second zone is brought to 270° C., and the temperature of catalyst C that is present in the second reactor is brought to 330° C.

The results that are obtained are noted in Table 5.

TABLE 5

| Temperature of Catalytic Zone A (° C.) | Sulfur Content of the Desulfurized Gasoline (ppm) | Olefin Content of the Desulfurized Gasoline (% by Weight) | Octane of the Desulfurized Gasoline (RON + MON)/2 |
|---|---|---|---|
| 260° C. | 49 | 23.6 | 83.3 |
| 280° C. | 10 | 20.2 | 82.3 |

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 00/08.860, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the production of gasoline with a low sulfur content, comprising at least three stages:

A) a first stage in which the sulfur-containing compounds present in the gasoline are at least partially transformed into H2S and into saturated sulfur-containing compounds, B) a second stage comprising separating H2S from the gasoline produced in stage A, C) a third stage in which saturated sulfur-containing compounds remaining in the gasoline are at least partially transformed into H2S, wherein the stage C is carried out in the presence of a catalyst comprising at least one metal of nickel, cobalt, iron, molybdenum, or tungsten, and the stage C is carried out with an $H_2$/HC ratio of 200–600 liters per liter.

2. A process according to claim 1, further comprising a pretreatment stage, before stage A, comprising hydrogenating diolefins in the feedstock.

3. A process according to claim 1, wherein the feedstock is a catalytic cracking gasoline.

4. A process according to claim 1. wherein stage A is carried out by passing the feedstock, in the presence of hydrogen, over a catalyst comprising at least one element selected from the group consisting of at least one element of group VIII and at least one element of group VIb, said catalyst being at least in part in sulfide form.

5. A process according to claim 4, wherein the element of group VIII, when it is present, is nickel or cobalt, and the element of group VIb, when it is present, is molybdenum or tungsten.

6. A process according to claim 5, wherein stage A is carried out at a temperature of between about 210° C. and about 350° C., under a pressure generally between about 1 and about 5 Mpa, with a volumetric flow rate of the liquid ofbetween about 1 and about 10 $h^{-1}$.

7. A process according to claim 1, wherein the metal content is between 1 and 60% by weight, and said metal is sulfurized.

8. A process according to claim 1, wherein stage C is carried out at a temperature of between about 200° C. and about 350° C., a pressure of between about 0.5 and about 5 Mpa, and a liquid volumetric flow rate between about 0.5 and about 10 $h^{-1}$.

9. A process according to claim 1, implemented with at least two separate reactors, not including a feedstock pre-treatment reactor, whereby the first reactor contains catalyst for stage A and the second reactor contains at least catalyst for stage C.

10. A process according to claim 1 implemented with at least two separate reactors, not including a feedstock pre-treatment reactor, whereby the first reactor contains at least a portion of the catalyst for stage A and the second at least another portion of catalyst for stage A and also catalyst necessary for stage C.

11. A process according to claim 1, wherein stage B for the elimination of H2S is carried out by adsorption in the presence of an adsorbent mass selected from the group consisting of zinc oxide, copper oxide and molybdenum oxide.

12. A process according to claim 1, wherein H2S is separated using a membrane.

13. A process according to claim 4, wherein stage C is carried out in the presence of a catalyst comprising at least one base metal selected from the group consisting of nickel, cobalt, iron, molybdenum and tungsten.

14. A process according to claim 5, wherein stage C is carried out in the presence of a catalyst comprising at least one base metal selected from the group consisting of nickel, cobalt, iron, molybdenum and tungsten.

15. A process according to claim 13 wherein the catalyst for stage A is different from the catalyst for stage B.

16. A process according to claim 15 implemented with at least two separate reactors, not including a feedstock pre-treatment reactor, whereby the first reactor contains catalyst for stage A and the second reactor contains at least catalyst for stage C.

17. A process according to claim 15 implemented with at least two separate reactors, not including a feedstock pre-treatment reactor, whereby the first reactor contains at least a portion of the catalyst for stage A and the second at least another portion of catalyst for stage A and also catalyst necessary for stage C.

18. A process according to claim 1, wherein the $H_2$/HC ratio is 300–600 liters per liter.

19. A process according to claim 1, wherein $H_2$/HC ratio is 330–600 liters per liter.

20. A process according to claim 1, wherein the stage C operates at a pressure substantially the same as stage A.

* * * * *